US006492966B1

(12) United States Patent
Christensen

(10) Patent No.: US 6,492,966 B1
(45) Date of Patent: Dec. 10, 2002

(54) INTEGRALLY FABRICATED GATED PIXEL ELEMENTS AND CONTROL CIRCUITRY FOR FLAT-PANEL DISPLAYS

(76) Inventor: Alton O. Christensen, 16106 S. Ravenswood, Magnolia, TX (US) 77355-1233

( * ) Notice: Subject to any disclaimer, the term of this patent is extended or adjusted under 35 U.S.C. 154(b) by 0 days.

(21) Appl. No.: 08/281,912

(22) Filed: Jul. 27, 1994

Related U.S. Application Data

(63) Continuation-in-part of application No. 06/419,501, filed on Sep. 17, 1982, now abandoned, and a continuation-in-part of application No. 06/798,587, filed on Nov. 15, 1985, now Pat. No. 4,663,559, and a continuation of application No. 07/046,521, filed on May 4, 1987, now abandoned, and a continuation-in-part of application No. 07/257,343, filed on Oct. 13, 1988, now abandoned, and a continuation of application No. 07/780,883, filed on Oct. 23, 1991, now abandoned, and a continuation-in-part of application No. 08/241,033, filed on May 10, 1994, now abandoned.

(51) Int. Cl.[7] ..... G09G 3/30
(52) U.S. Cl. ..... 345/76; 345/80
(58) Field of Search ..... 313/498–505, 313/36, 45; 345/76–80, 194.3

(56) References Cited

U.S. PATENT DOCUMENTS

| | | | | | |
|---|---|---|---|---|---|
| 2,817,783 | A | * | 12/1957 | Loebner | 313/499 |
| 3,398,311 | A | * | 8/1968 | Page | 313/499 |
| 3,443,141 | A | * | 5/1969 | Mooser et al. | 313/499 X |
| 3,461,344 | A | * | 8/1969 | Rich | 345/80 X |
| 3,492,548 | A | * | 1/1970 | Goodman | 313/499 X |
| 3,560,784 | A | | 2/1971 | Steele | |
| 3,916,227 | A | * | 10/1975 | Mize | 313/505 X |
| 4,006,383 | A | | 2/1977 | Luo et al. | |
| 4,015,166 | A | | 3/1977 | Ohshima et al. | |
| 4,140,937 | A | | 2/1979 | Vecht et al. | |
| 4,143,297 | A | | 3/1979 | Fischer | |
| 4,266,223 | A | * | 5/1981 | Frame | 345/80 |
| 4,486,499 | A | | 12/1984 | Morimoto | |
| 4,663,559 | A | * | 5/1987 | Christensen | |
| 5,294,870 | A | * | 3/1994 | Tang et al. | 345/76 X |
| 5,384,517 | A | * | 1/1995 | Uno | 313/499 X |

* cited by examiner

*Primary Examiner*—Chanh Nguyen
(74) *Attorney, Agent, or Firm*—Gunn & Associates, P.C.

(57) ABSTRACT

Triode pixel devices and complementary triode logic devices for control of the pixel devices are disclosed. The pixel and logic devices are integrally fabricated in arrays suitable for full color flat display panels. Both pixel and logic elements are operated in a gate controlled avalanche mode. Pixel elements are formed from organic or inorganic electroluminescent (EL) materials ohmically contacted by low work function metal. The depletion region necessary for controlling EL intensity or preventing EL avalanche is affected by potentials to a gate element injected into the EL material. The shape of the gate element multiplies the field produced by the gate potential. Luminescence is directly viewed from the brighter, lateral EL emission not available in the prior art. The complementary logic devices are formed from separate depositions of n-type and p-type silicon with their respective gates connected in common. A manufacturing process to produce economical full color, large area, flat-panel, displays of high pixel density and redundancy is described. Small area high pixel density displays suitable for head-mounted military, avionic, and virtual reality display products are also discussed.

16 Claims, 5 Drawing Sheets

P-TYPE DEVICE
NUMERAL 40
LAYER 32: p-DOPED Si, SiC, CdSb

N-TYPE DEVICE
NUMERAL 50
LAYER 39: n-DOPED Si, SiC, CdTe

INTEGRALLY FABRICATED GATED PIXEL ELEMENTS AND CONTROL CIRCUITRY FOR FLAT-PANEL DISPLAYS

This application is a Continuation-In-Part of Ser. No. 06/419,501 filed Sep. 17, 1982, now abandoned; also a CIP of Ser. No. 06/798,587 filed Nov. 15, 1985, now U.S. Pat. No. 4,663,559; also a continuation of Ser. No. 07/046,521, filed May 4, 1987, now abandoned; also a CIP of Ser. No. 07/257,343, filed Oct. 13, 1988, now abandoned; also a continuation of Ser. No. 07/780,883, filed Oct. 23, 1991; now abandoned; also a CIP of Ser. No. 08/241,033, filed May 10, 1994 now abandoned.

BACKGROUND OF THE DISCLOSURE

This disclosure sets forth a design for integrally fabricated gated triode pixel elements and the associated control circuitry for flat panel or virtual reality displays. In addition, methods for manufacture of the integrated devices are disclosed.

Prior art electroluminescent (EL) devices used in flat panel displays are diodes in which applied alternating current (AC) or direct current (DC) or pulse potentials affect luminescence. The diode or two terminal embodiment of flat display panel pixels presents significant operational and manufacturing limitations. One limitation is in the form of barrier contacts at both the injector and the collector terminals of the diode. These barrier contacts increase significantly the potential required for luminescence, and decrease the operational lifetime of the device because of cumulative terminal EL material interface stress. The stress of the high field of the non-ohmic contacts to the EL material affects the interface therebetween, degrading operation and causing failure. Another limitation is the increased complexity of address and intensity modulation necessary for use as pixel elements in information display.

Still another limitation is that the address and intensity modulation circuitry must be separately manufactured and assembled to prior art diode pixel display devices thereby increasing the cost of the display product. Another limitation is the power requirements for the control circuitry which are orders of magnitude greater than the control circuitry for the presently disclosed device. Still another limitation of the diode pixel element is that light is emitted through the diode's transparent contact and not laterally as will be expanded upon in the following paragraph. This results in a significant percentage of light emission that is not utilized thereby, further increasing the power required in the prior art to obtain the desired level of luminescence.

In prior art DC diode devices, one contact to the EL material of the diode is made by transparent indium-tin oxide, and the other by a metal which is typically Al. Both of those contacts are Schottky barrier, tunneling contacts. A reverse bias applied to the EL material produces a field across the depletion region. A sufficient field causes avalanche of energetic carriers which are typically electrons. The electrons impact and excite centers, or color centers of the EL material, creating electron-hole pairs, and/or excitation of the color dopant atoms. Relaxation of the excitation within the EL material causes photon, colored light, emission. Only the photons exiting the EL material parallel to the field produce the viewed light. The greater brightness produced laterally, perpendicular to the field, is essentially lost and does not markedly contribute to the brightness of the viewed light of the prior art.

BRIEF SUMMARY OF THE INVENTION

The current invention comprises triode pixel devices and complementary triode logic devices for control of pixel devices. Both the pixel devices and the associated control circuitry are fabricated and interconnected in the same continuous manufacturing process to economically produce full color flat panel display products. Both pixel and logic devices are operated in a gate controlled avalanche mode.

Pixel elements are formed of inorganic or organic EL material ohmically contacted by low work function metal. The depletion region necessary for controlling EL intensity or for preventing EL avalanche is affected by potentials to a gate element injected into the EL material. The shape of the gate element multiplies the field produced by applied gate potential. Luminescence is directly viewed through the glass substrate, without an indium tin oxide layer and its 10% light transmission loss, from the brighter, lateral EL emission, not available in the prior diode pixel art. Each pixel element can be surrounded by an optically absorbing black oxide, the equivalent of a TV tube's black mask, increasing pixel contrast and definition. The complementary logic devices are formed from separate depositions of n-type and p-type silicon with their respective gates connected in common. The operating potentials required are those of integrated circuits and are therefore low. Power consumption is reduced and the devices present no electromagnetic hazard to users. The ohmic contacts to EL material and the gate terminal of the present disclosure overcome operating lifetime and failure problems of the prior art DC operated EL devices. Those failure mechanisms, which are overcome by the present disclosure, are well described by J. M. Blackmore, et al., *Journal of Applied Physics* 61, No. 2, p.714–733.

To achieve the aforementioned objects, uses and advantages, a deposited mixture of metal and oxide particles interfaces with semiconductors and/or oxides. The mixture is sputter deposited in a 10% hydrogen 90% argon atmosphere. The random mixture of particles of 50 Å maximum diameter is graded such that 28% to 32% of the receiving surface area is metal particles. At barrier contact to the semiconductor depletion region, the oxide particles isolate a multiplicity of metal particles of the mixture such that fields about the metal particles are enhanced over that obtained between the essentially planar surfaces of the prior art. That enhanced field increases tunneling current density at a given field potential. The multiplicity of tunnel current sources, as compared to the prior art, provides a more uniform and additional increase in tunnel current density. In contact to highly doped semiconductor, the mixture makes better micro-ohm-cm$^2$ contact to the semiconductor, enhancing device operation and speed over the prior art. The mixture prevents migration of metals into semiconductors. The simple and economic process disclosed replaces difficult and less reliable silicide formation in the semiconductor of prior art contact processes. The ratio of 30% metal particles is optimum. A range of 28–32% can be routinely achieved. The range can be extended to about 25–40% with a loss of benefit. In general terms, the 30% figure is best for optimum tunneling.

The particle mixture improves the ohmic contact to interfacing oxide layers. The ohmic contact is used to eliminate one of the two serial barriers that applied fields otherwise overcome to tunnel charge stored in floating gates. Elimination of one barrier lowers potentials and increases device life.

DETAILED DESCRIPTION OF THE INVENTION

The metal and oxide materials of the random mixture are chosen such that the work function of the oxide is sufficiently greater than the work function of the metal whose other characteristics combine to enable ohmic contact with oxides.

The preferred oxide is typically defined by the oxide used in the manufacturing process of the device. Silica is the preferred oxide for interfacing with silica or silicon. Other oxides, which like silica make ohmic contact with the preferred metal, are alumina and beryllia.

The preferred metal $Cr_3Si$ is an A15 compound, congruently melts at 1770° C., has a coefficient of thermal expansion of $10.5\times10^{-6}$/°C. typical of a silicide, and does not oxidize at temperatures below 1050° C. The heat of formation of $Cr_3Si$ of −32.4 kcal/mole correlates to a barrier of 0.55 ev to either N-doped silicon or P-doped silicon. The advantage of equal barriers to oppositely doped silicon is not ordinarily achieved in prior art IC processes. However, the conductivity of $Cr_3Si$ is about 1/15th that of aluminum, so that more conductive materials are used in contact with $Cr_3Si$ for interconnections to other IC elements. Alone or in a mixture with oxides, the very high free surface energy of $Cr_3Si$ provides strong adherence to many common materials used in IC manufacture, and an effective barrier to the migration of metals (e.g., aluminum) into semiconductor. The prior art teaches formation of silicides into semiconductors to bar such migrations which cause failure of devices, but the siliciding process itself is a source of failure.

BRIEF DESCRIPTION OF THE DRAWINGS

So that the manner in which the recited features, advantages and objectives of the present invention are attained and can be understood in detail, more particular description can be had by reference to the embodiments thereof which are illustrated in the appended drawings. It is to be noted, however, that the appended drawings illustrate only typical embodiments of the invention and are not considered limiting of its scope, for the invention may admit to other equally effective embodiments.

JUNCTION DETAILS

Figure 18:
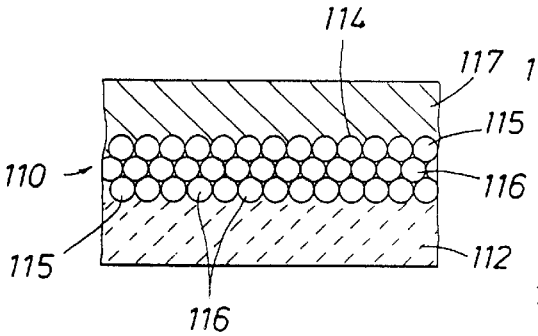
FIG. 18 is a partial sectional view of the graded deposition of the present disclosure interfacing to semiconductor structures of the prior art.

The sectional view of FIG. 18 of the drawings discloses the structure 110 comprised of a graded layer 114 of the mixture of the preferred embodiment deposited onto an interfacing semiconductor layer 112. The mixture typically is comprised of 50 Å average diameter particles of $Cr_3Si$ 115 and silica 116. The initial portion of the deposited layer 114 immediately interfacing the layer 112 is 28% to 32% (of the surface area) $Cr_3Si$ and the remainder is silica 116. The initial portion of the deposited layer 114 immediately interfacing the layer 112 is 28% to 32% (of the surface area) $Cr_3Si$ particles 115. As the deposition of 114 continues, the grading changes its composition to more Cr3Si 115 particles, and less silica particles 116, until the uppermost portion of 114 is almost all $Cr_3Si$ particles. The grading is completed in a thickness of 3 to 5 particle diameters, such that any continuation is 100% $Cr_3Si$ at the layer 117. The layer 114 having $Cr_3Si$ particles 115 and silica particles 116 makes barrier contact to the layer 112 of semiconductor. The layers 114 and 117 both provide enhanced adhesion to, and prevent migration of, conductor material into the semiconductor layer 112. The layer 117 is optionally used to provide ohmic contact to a conductor such as aluminum, doped polysilicon, or metal suicides commonly used in IC manufacture.

Noteworthy of the layer 114 is the high density of $Cr_3Si$ particles 115 insulatively separated by oxide particles 116 against the interface barrier contact with the semiconductor layer 112. The typical density of $1.6\times10^{12}/cm^3$ $Cr_3Si$ particles 115 at the interface with the semiconductor 112 provides more uniform tunneling than that between the essentially planar surface of the prior art. The insulative separation between individual $Cr_3Si$ particles 115 by oxide particles 116 provides an enhancement of the tunneling field about $Cr_3Si$ particles 115, typically about 7.5 times than that between prior art contact surfaces.

Figure 19:
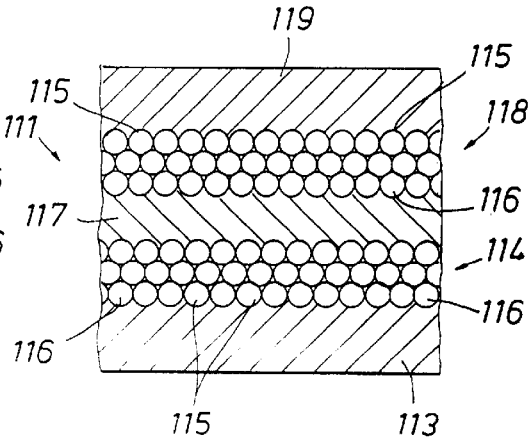
FIG. 19 is a partial sectional view of the doubly graded deposition of the present disclosure providing ohmic contact between insulator layers.

Noteworthy also is the 0.55 ev barrier of $Cr_3Si$ particles 115 to the semiconductor layer 112 of silicon, being half the silicon bandgap, and therefore a 0.55 ev barrier equally to both P-doped and N-doped silicon, not readily achieved in the prior art. Referring now to FIG. 19, the sectional view discloses the high speed gate structure 111 illustrating large area ohmic contact between two insulator layers 113 and 119. The intermediate layers 114, 117 and 118 may be used to perform the function of and replace the floating gate in prior art nonvolatile storage devices. Over an insulator layer 113, typically silica, the layers 114 and 117 are deposited as described above in connection with FIG. 18. However, in this embodiment, the process is continued to form the layer 118 in which the grading of the deposition is repeated, such that the final or last portion of the deposited layer 118 is made 28% to 32% of the surface area $Cr_3Si$ particles 115 and the balance is silica particles 116. The process can then continue to deposit only silica to form the topmost layer to the desired thickness. To summarize, the layer 114 increases from about 30% $Cr_3Si$ to 100% $Cr_3Si$ while the layer 118 decreases in the same fashion.

The total ohmic contact area of the aggregate surface of $Cr_3Si$ particles 115 in the layers. 114 and 117, is (1) with the silica particles 116, (2) to the silica layer 112, and (3) similarly in the layer 118 to the silica layer 119. The contact area is about 1.28 times the surface area of layers 112 to 119. In other words, one unit of surface area is coupled through an enhanced area of 28% more than the unit surface area. This enhanced area markedly changes the speed of data propagation, reduces operating voltages and has other virtues as discussed elsewhere in this disclosure.

Figure 14:
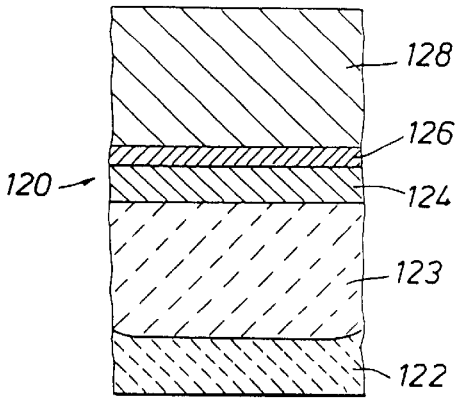
FIG. 14 (PRIOR ART)
FIG. 14 illustrates in partial sectional view the prior art contact to semiconductor.

Referring now to FIG. 14 of the drawings, the typical prior art contact to semiconductor is illustrated in partial section view at 120. In a substrate 122, a junction 123 has been formed having a highly doped layer 124. In the highly doped layer 124, metal silicide 126 is formed, which consumes a percentage of the volume of the layer 124 in its formation, and which makes barrier contact to 124. The layers 123 and 124 of the fast devices of the prior art are shallow, less than about 0.5 micron thick. If the proportion of the layer 124 consumed by the layer 120 increases, the contact becomes less reliable. The suicide layer 126 forms a barrier to migration of interconnecting metals 128, such as aluminum, into and through the layers 124 and 123.

Figure 16:
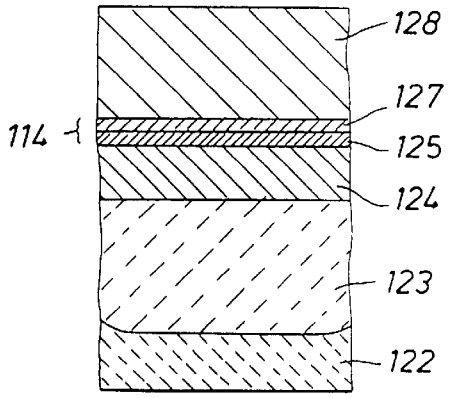
FIG. 16 illustrates (in contrast with FIG. 14) in partial sectional view the application of the structure of the present disclosure to form a micro-ohm-$cm^2$ tunneling contact to semiconductor.

Referring now to FIG. 16, the preferred embodiment micro-ohm-$Cm^2$ contact to semiconductor is illustrated in partial sectional view 121. The reference numerals and description are the same as in FIG. 14, except that layers 125 and 127 have been substituted for the layer 126. The layer 125 is the same as the layer 114 of FIG. 18, namely graded deposition of $Cr_3Si$ and silica particles. The layer 127 is 100% $Cr_3Si$. The layer 125 is a 0.55 ev barrier to silicon semiconductor at its interface with the layer 124. The features of enhanced field about the multiplicity of $Cr_3Si$ particles in the layer 125 interfacing to the semiconductor layer 124 form the micro-ohm-Cm2 contact to the semiconductor layer 124. A very helpful fact is that the thickness of the layer 124 has not been diminished as in FIG. 14 by formation of the silicide layer, thus yield in fabrication is enhanced. The layers 127 and 125 form an effective barrier to migration of metals, such as aluminum, into the semiconductor 124.

Figure 15:
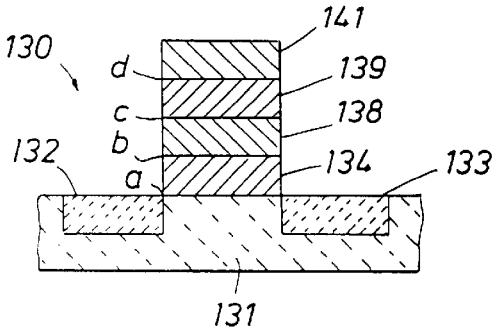
FIG. 15 (PRIOR ART)
FIG. 15 illustrates in partial sectional view a prior art embodiment of a floating gate nonvolatile storage device.

Referring now to FIG. 15, a floating device 130 of the prior art is illustrated in partial sectional view. A substrate 131 contains source and drain junctions, 132 and 133, and a gate oxide area 134 is therebetween and above. Next above the gate oxide 134 is the floating gate 138, then a gate oxide layer 139, and then the programming gate 141. The four gate layer interfaces (where the barrier to tunneling exists) are labeled alphabetically, a through d. In the prior art, one or two of those interfaces are selected for the field enhancement, depending on whether the device is P-channel or N-channel, and whether programming is from the gate 141 alone, or by gate 141 and avalanche from the substrate 131.

Figure 17:
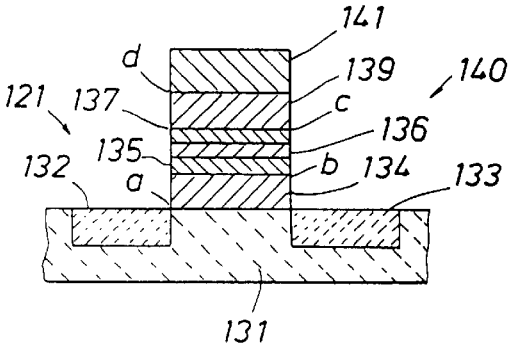
FIG. 17 illustrates (in contrast with FIG. 16) in partial sectional view the application of the structure of the present disclosure to form a floating gate providing enlarged area ohmic contact between silica layers of a nonvolatile memory device.

Referring now to FIG. 17, the floating gate device 140 of the present disclosure is illustrated in partial sectional view. As in FIG. 15, the substrate 131 again contains source and drain junction 132 and 133, and the gate oxide layers 134 and 139 therebetween and above, and also a programming gate 141. Note the elimination of two of the barrier of the prior art namely, the oxide-floating gate barriers at the interface b, and the oxide-floating gate barrier at the interface c.

The floating gate structure of this embodiment 140 of the invention includes a graded deposition 135, 136 and 137, similar in detail to layers 114, 117, 118 respectively in FIG. 19. The layer 135 makes ohmic contact with an enhanced contact area with the gate silica layer 134. The layer 137 makes ohmic contact with an enhanced contact area with the gate silica layer 139. It follows that deposition shown in FIG. 19 could be made in prior art devices at the other interfaces to eliminate the tunneling barriers thereat. The choice of which barriers to eliminate, and the thickness of the various gate oxide layers, depend upon the desired operational conditions selected by the device designer.

A disclosure of the gated pixel elements and control circuitry will first be presented followed by details concerning the manufacturing process used to produce the integrated pixel control circuit devices.

The Triode Pixel and Associated Control Circuitry

Figure 1:
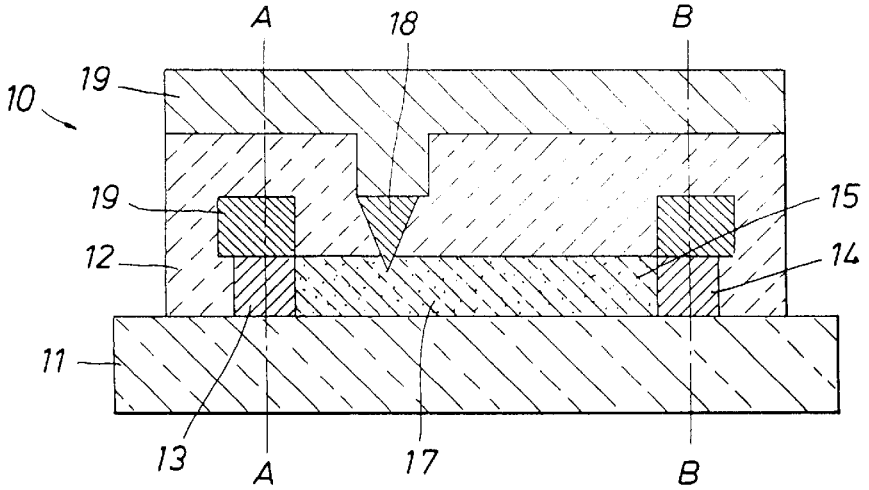
FIG. 1 is a schematic cross-sectional representation of a single gated pixel element employing inorganic electroluminescent material.

Attention is drawn to FIG. 1 which illustrates a cross section of an inorganic pixel element identified in general by the numeral 10. The elements of the pixel are affixed to the substrate 11 which is typically optical glass. Each pixel element is a triode device comprising an injector electrode 13, a collector electrode 14 and gate electrode 18 enclosed by a dielectric material 12 such as a black, optically absorbing oxide such as niobium dioxide ($NbO_2$) which serves to increase definition and contrast, or simply silica. Injector 13 and collector 14 are typically $Cr_3Si$ metal making ohmic contact to the EL material. The gate electrode is made of high barrier-to-EL material compatible with the gate interconnect metal 19. If gold (Au) is the gate interconnect metal 19, then gate electrode 18 may be Au. If interconnect metal 19 is an Al alloy, then gate electrode metal 18 can be made of copper (Cu) or platinum.

The EL material 15 is typically color doped semiconductor material, ZnS being an example, or II-II-VI ternary compounds such as $Zn_xCd_{1-x}S$, or semiconductor SiC, or compounds containing an oxide such as zinc gallate. A potential is applied between the injector 13 and collector 14 across the EL material 15. The polarity of the potential applied between the injector 13 and the collector 14 depends upon the conductivity type of the EL material. The EL material is suitably color doped to produce red, green or blue electroluminescence. The injector and collector metal contacts to the EL material 15 are non-tunneling, ohmic contacts. Arrays of pixel devices of FIG. 1 are constructed by rotating the cross-section alternately about axes A—A and B—B, as shown in a subsequent section and Figure.

Near the injection contact is the gate electrode 18 of the pixel element which is a Schottky barrier metal contact to the EL material. The Schottky gate contact is deposited as a pointed protrusion into the EL material. That gate creates and modulates a depletion region 17. The point contact geometry of the gate 18 has the advantages of (1) enhancing the depleting field above that of a planar contact by a factor of 10 or more, (2) reducing the capacitance that the control circuitry must drive, (3) reducing the potential required for full depletion, (4) minimizing off condition leakage current which is reduced by increased depletion volume, and therefore (5) reducing the overall power required to operate the device. Variation of the magnitude of the gate potential produces a depletion region 17 in the EL material 15 of variable width and volume. In the non-luminescent condition, the magnitude of the gate polarizing potential increases the depleted volume such that avalanche of the EL material cannot occur at the potential applied injector-to-collector. As the magnitude of the gate potential is reduced, the width and volume of the depletion region is reduced such that at a threshold value and less, avalanche of the EL material occurs producing luminescence. That luminescence is viewed through the glass substrate 11. The luminescence viewed is that generated perpendicular to the avalanche field. That laterally emitted light is five times more intense than prior art light emission parallel to the axis of the applied potential, as has been shown by D. H. Smith, *J. of Luminescence* 23, 209, 1981 and confirmed by R. Stevens, et al, *Electron Device Letters* 15, No. 3, 97. In flat panel display uses, the control system is required to produce a non-avalanching potential to gate 18 prior to application of potential across terminals 13 and 14.

Figure 2:
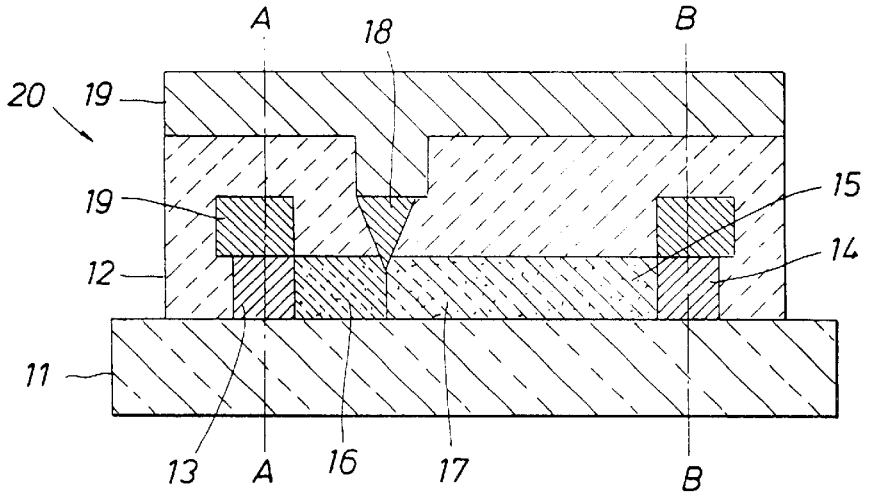
FIG. 2 is a schematic cross-sectional representation of a single gated pixel element employing a hole transport element and organic or inorganic EL materials.

Attention is now drawn to FIG. 2 which is also a cross sectional representation of the pixel device, identified by the numeral 20, illustrating an additional material 16 between the injector 13 and the EL material 15. The purpose and effect of the HT material 16 is to increase luminescent efficiency by increasing the number of luminescent electron-hole recombinations within the EL material and decreasing recombinations at a terminal contact. Suitable HT materials for use with n-type EL have a higher hole mobility than electron mobility.

In the case of inorganic materials for example, n-type II-VI EL material 15 is made of ZnS and HT material 16 is made of a II-IV-$V_2$ ternary compound semiconductor $ZnSiAs_2$, and in the interface 17 therebetween a type of p-n junction is formed. The hole mobility of $ZnSiAs_2$ is orders of magnitude larger than organic HT materials.

In the case of organic EL and HT materials for example, 15 is a color doped metal chelate of J. Kido (previously referenced), such as 8hydroxylquinoline aluminum or Tris (8-quinolinolato) aluminum III, commonly referred to as "$Alq_3$". The HT layer 16 is a compounded polymer/diamine. In both organic and inorganic examples, the gate electrode 18 is deposited into the interface 17 and forms a Schottky barrier contact to both materials. Unless noted otherwise, all other description concerning the elements of FIG. 1 apply also to FIG. 2.

Figure 3:
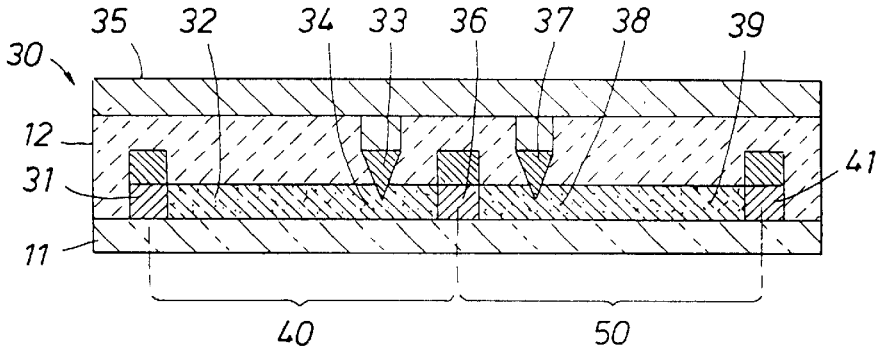
FIG. 3 is a schematic cross section of complementary logic elements.

Complementary logic elements are used to control the pixel elements. More specifically, the logic elements required to address and control the brightness of the pixel elements are made in the same continuous process as the pixel elements. A cross section of the logic element, identified by the numeral 30, is shown in FIG. 3. The logic elements are constructed on the same glass substrate 11 and isolated by the same deposited. dielectric layers 12 as the pixel devices. Each logic element 30 is comprised of gated unipolar doped n-type and doped p-type devices. The unipolar devices have commonly connected gates and a common output node 36. The p-type device, denoted by the numeral 40, is comprised of an injector 31 of the same aluminum (Al) alloy used for interconnection. Injector 31 is at a positive potential in ohmic contact with deposited p-type silicon 32. Gate 33 is preferably made of Cu metal thereby producing an, adjacent depletion region volume 34. An opposing barrier contact 36 of $Cr_3Si$ is in common with n-type device 50. The present inventor in U.S. Pat. No. 3,686,644 teaches the use of n-p-n and p-n-p devices operating in complementary mode to charge capacitive loads. No prior art has been found teaching Schottky gated unipolar devices or such unipolar devices connected in this complementary manner. $Cr_3Si$ has a barrier of 0.55 eV to both n-type and p-type silicon. The n-type device 50 has the common output node 36 with p-type device 40, a gate 37 producing and modulating a second depletion region volume 38 adjacent, and a ground terminal barrier contact 41 made preferably of $Cr_3Si$ metal. Output node 36 is preferably $Cr_3Si$ metal and the gate 37 is preferably Cu metal. The device gates are formed in the same manner, and have the same advantages as the pixel element gates and are connected in common by the deposited Al alloy 35. The doping levels are adjusted such that when power is first applied, the p-type device avalanches thereby charging output node 36. Output node 36 is connected to other gates, primarily a capacitive load. Avalanche is self extinguished when that node is charged to a potential at which avalanche can not be sustained. The normal gate potential is such that the depletion region 38 is-too wide to allow avalanche of n-type device 50. Changing the amplitude of the gate potential allows device 50 to avalanche and prevents avalanche of the device 40 and discharges the charged node 36.

The cooperation of the control circuit and pixel elements will be discussed in a subsequent section.

In summary, the disclosed triode pixel and integrally fabricated control circuitry designed for flat panel displays exhibits the following significant improvements over prior art devices:

(1) Power consumption is reduced;

(2) Reliability and operating life is increased;

(3) Luminescence is increased per unit of power consumption;

(4) Manufacturing costs are reduced; and (5) Electromagnetic fields which could be harmful to operators of flat panel devices are eliminated.

A Brief Outline of the Manufacturing Steps

The following description is directed toward those versed in the art of integrated circuit manufacturing. The description is a step by step outline of masking and deposition operations that can be employed to produce the previously described integrated pixel and control devices. FIGS. 4 through 12 are cross sectional views of the device illustrating the sequential masking and deposition steps.

Figure 4:
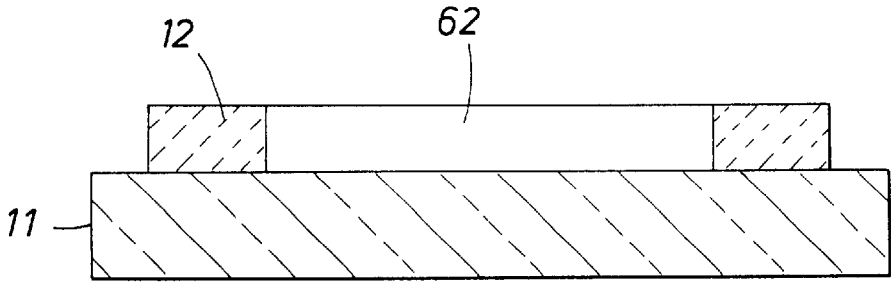
FIG. 4 illustrates a first mask for EL and silicon depositions.

FIG. 4 illustrates in cross-section a volume 62 into which, in separate steps, EL materials, n-type and p-type silicon are subsequently deposited. The optical glass substrate 11 through which the generated light is viewed is first coated by a layer of dielectric material 12. An optically black material such as $NbO_2$ may be used if a black pixel mask is desired; otherwise the layer 12 may be silica. Deposition by electron cyclotron resonance (ECR) means is preferred, or EL materials maybe deposited by metal organic methods. Except where noted, dielectric and/or photoresist with overlaying deposited material is removed by plasma etching and/or liftoff. The dielectric layer is masked and apertures 62 for each EL and silicon area are delineated and then formed by anisotropic etching.

Figure 5:
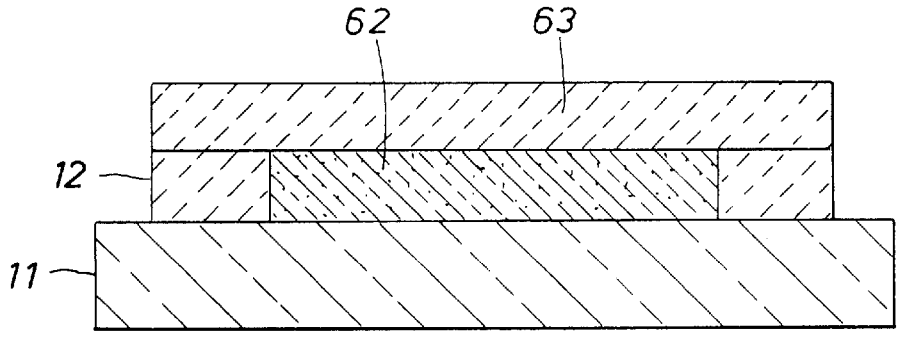
FIG. 5 illustrates completion of EL and dielectric overlayer depositions.

Into each individual volume 62 is deposited red (R), green (G) or blue (B) doped EL material, or n and p doped silicon. When all deposition steps have been completed and excess materials removed, then ECR deposition of dielectric material 63 covers all deposited areas as depicted in FIG. 5. Dielectric 63 may be optically absorbent black oxide dielectric, such as $NbO_2$ for increased pixel definition and contrast, or simply silica.

Figure 6:
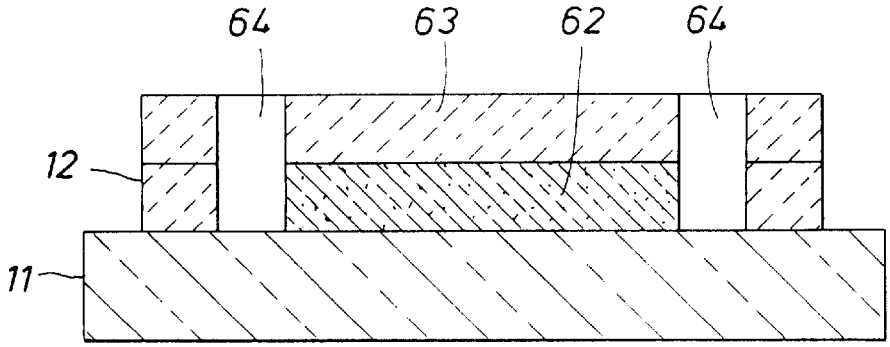
FIG. 6 depicts etched contact holes for EL and silicon metal.

Apertures 64 to all EL and n-silicon metal contacts volumes are delineated and anisotropically etched through dielectric layers 63 and 12 as shown in FIG. 6. The remaining contact to p-silicon is made ohmically by subsequent Al interconnect deposition.

Figure 7:
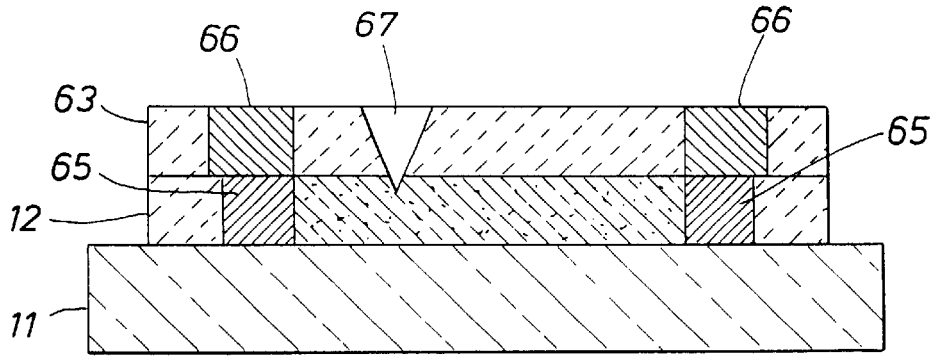
FIG. 7 shows delineation and etching of contact holes for EL and n-silicon.

FIG. 7 illustrates the deposited metal contacts 65 within apertures 64 which are in contact with substrate 1I. After deposition of the contact metal, dielectric 63 is further delineated, and interconnect metal 66 is deposited. The interconnections from device contacts 66 run perpendicular to the cross section view depicted in FIG. 7. Next, the contact hole 67 for subsequent gate metal deposition is delineated and isotropically, wedge-shape, etched through dielectric 63 and into the EL material below.

Figure 8:
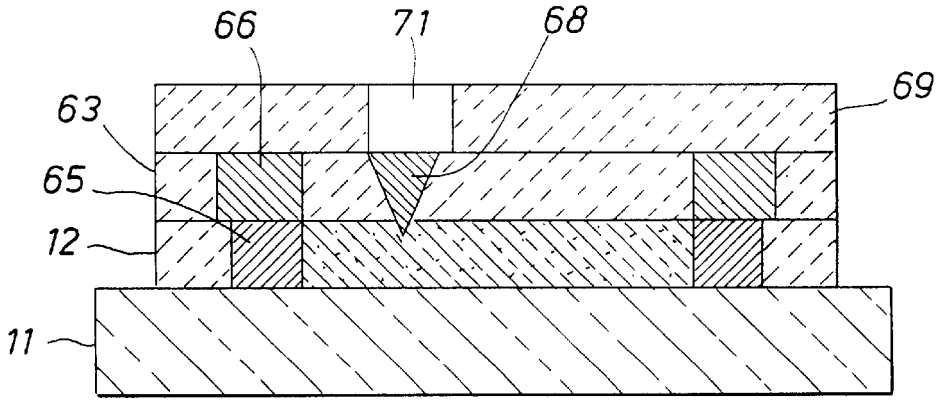
FIG. 8 shows deposition of gate metal through delineated aperture in overlying dielectric.

Referring now to FIG. 8, gate metal 68, preferably Cu is deposited into the aperture 67 of FIG. 7. Then an additional dielectric layer 69 of the same material as the numbers 12 or 63, or silica is deposited. The purpose of dielectric 69 is to provide isolation for subsequently deposited second metal layer. Dielectric 69 is delineated and anisotropically etched to form a contact hole 71 to gate 68.

Figure 9:
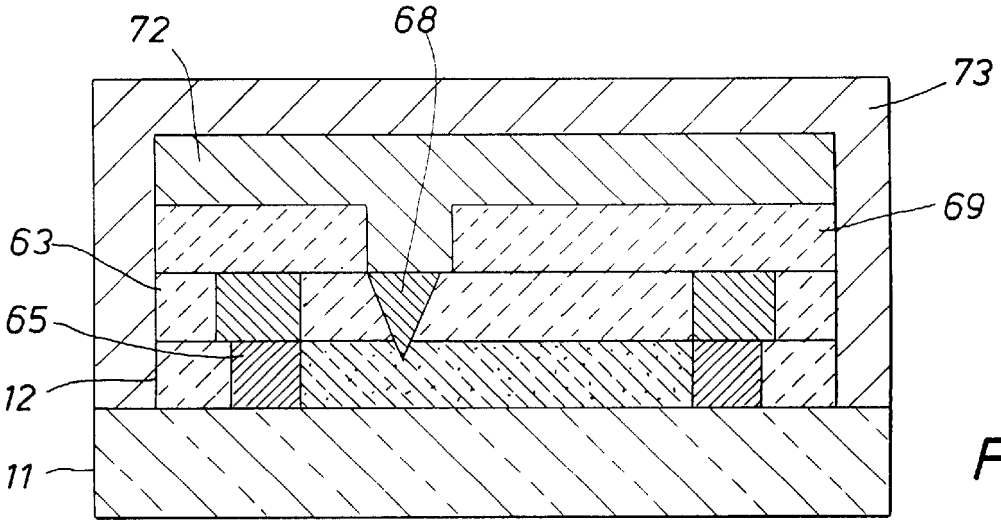
FIG. 9 shows deposition of gate contact metal and overall encapsulant.

FIG. 9 illustrates the completed process. A second layer of interconnect metal 72 is deposited and delineated to make contact with the interconnect metal 71 in contact with the gate 68 to thereby interconnect the gate 68 to control circuitry illustrated in FIG. 12. An overall layer 73 of a suitable encapsulating material is next applied.

Figure 10:
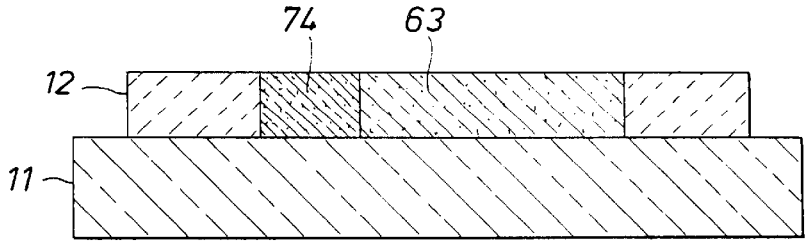
FIG. 10 illustrates the deposition of hole transport material for pixel devices only.

Referring now to FIG. 10, the process variant incorporating HT material is illustrated. The steps illustrated in FIG. 10 take place immediately following deposition of EL material step as given in the above description of FIG. 5. In pixel devices in which HT material is to be used, an aperture is anisotropically etched into both the dielectric 12 and EL material, into which HT material 74 is deposited.

Figure 11:
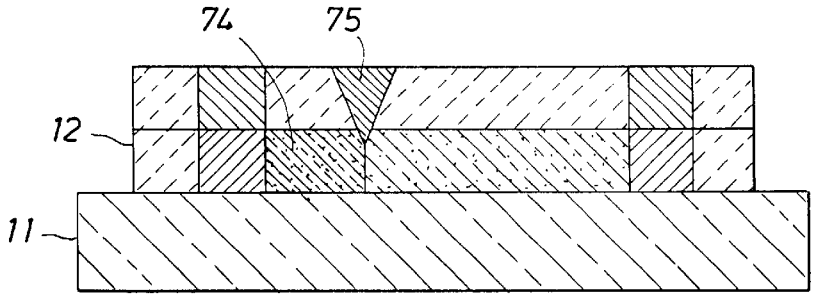
FIG. 11 illustrates gate placement for EL devices only.

FIG. 11 illustrates the placement of the gate 75 when a HT layer 74 is incorporated into the manufacturing process. The gate 75 is formed of Cu in the same process sequence as given under FIG. 8.

Figure 12:
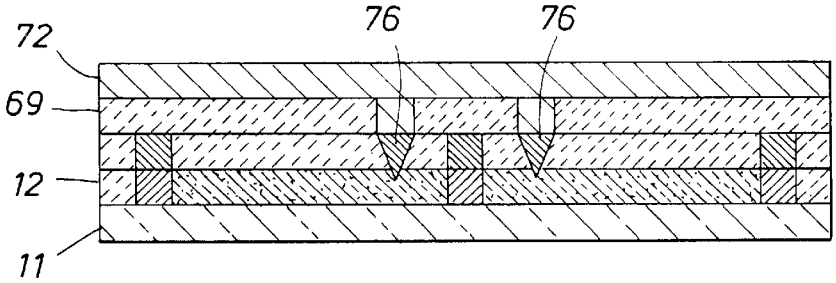
FIG. 12 illustrates the gate connections for a complementary circuit control device.

FIG. 12 illustrates the complementary silicon devices made in the same steps described under FIGS. 1 through 9. Gates 76 are commonly connected by interconnect metal 62.

Interconnection of Pixel and Control Devices

Figure 13:
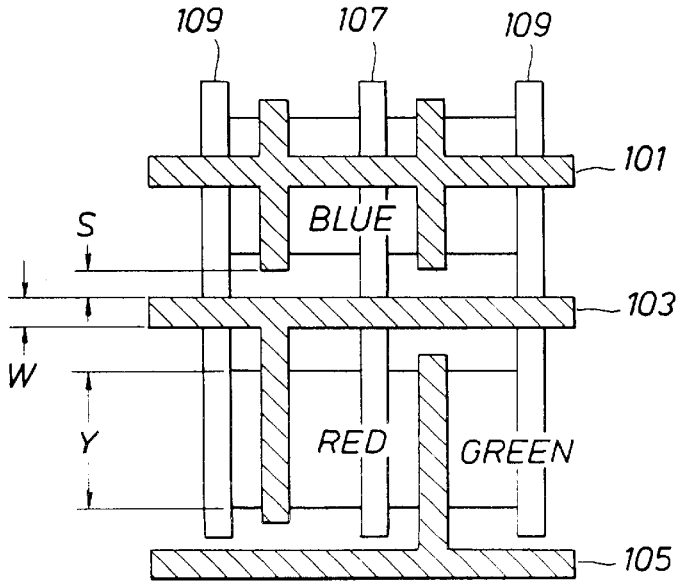
FIG. 13 depicts a planar view of a color addressable pixel assembly.

The planar view of FIG. 13 illustrates four interconnected pixel devices of FIG. 10 in cross-section, one each Red and Green and two Blue, comprising one full color pixel element of a display. The cross hatched metal of FIG. 13 is a second layer metal 72, insulated from and above the common ground connections 109, and addressed through the power connection 107. A full color pixel is comprised of an array of R, G and B pixel devices whose column addresses are connected in parallel, and whose row gates are addressable by color. Thus, row gate addressing by color devices 101, 103, and 105 while the column address connection 107 achieves a full color addressable pixel.

Pixel Size and Density

The topology illustrated in FIG. 13 may be used in a manifold redundancy as a single pixel in large area flat panel displays. Each color pixel is expandable principally in the indicated Y dimension in FIG. 13 to the requirements of pixel density.

The minimum area required by the topology of FIG. 13 depends upon the minimum dimension set for line width, indicated as w, and spacing between lines indicated by s on FIG. 13. If fabricated with w=s=.2.5 micron the full color pixel illustrated produces a density of 0.5 million pixels per square inch, or a monocolor pixel density of about 2.5 million pixels per square inch. Or, if w=s=1.25 micron design rules, about 2 million full color pixels per square inch are fabricated in the topology of FIG. 1, or about 10 million monocolor pixels per square inch. Such pixel densities are desired for high definition military and avionic head mounted displays, and for virtual reality displays.

The foregoing is directed to the preferred embodiments of the invention, but the scope of the invention is determined by the claims which follow.

What is claimed is:

1. An integrally fabricated gated pixel element in a display of plural pixel elements affixed to a common optically transparent substrate wherein said pixel element comprises:

(a) electroluminescent material;

(b) an injector electrode of $Cr_3Si$ in ohmic contact with said electroluminescent material;

(c) a collector electrode in ohmic contact with said electroluminescent material;

(d) a gate interconnect to enable a control gate signal to be applied to said pixel; and (e) a gate electrode in contact with said electroluminescent material and said gate interconnect.

2. The apparatus of claim 1 wherein said gate electrode comprises a point in said electroluminescent material and said electroluminescent material is color doped and said electroluminescent material is inorganic.

3. The apparatus of claim 1 wherein said collector is $Cr_3Si$.

4. The apparatus of claim 1 wherein:

(a) said gate electrode comprises a high barrier to electroluminescent material;

(b) said gate electrode is Cu and said gate interconnect is aluminum or an alloy thereof; and (c) said electroluminescent material is ZnS, II-II-Vi ternary compounds, SiC or compounds containing an oxide and is color doped to produce red, green or blue electroluminescence.

5. The apparatus of claim 1 wherein said electroluminescent material is doped with 8hydroxyquinoline aluminum or Tris(8-quinolinolato) aluminum III to produce color electroluminescence.

6. The apparatus of claim 1 including hole transport material $ZnSnAS_2$, $SnSiAs_2$ with ZnS, or polymer/diamine with $Alq_3$ in said electroluminescent material.

7. The apparatus of claim 1 wherein dielectric material of $NbO_2$ encapsulates said pixel element.

8. An integrally fabricated, gated control element in a display on a supportive substrate wherein said element comprises:

(a) a current controlled material;

(b) an injector electrode of $Cr_3Si$ in ohmic contact with said current controlled material;

(c) a collector electrode in ohmic contact with said current controlled material;

(d) a gate interconnect to provide a control gate signal; and (e) a gate electrode in contact with said gate interconnect to control current flow to said current controlled material.

9. The apparatus of claim 8 wherein said gate electrode comprises a point in said current controlled material; and said current controlled material is electroluminescent.

10. The apparatus of claim 9 wherein:

(a) said electroluminescent material is inorganic;

(b) said collector is $Cr_3Si$; and (c) said supportive substrate is transparent.

11. The apparatus of claim 10 wherein said gate electrode is Cu and said gate interconnect is aluminum or an alloy thereof and further includes dielectric encapsulating material around said element.

12. The apparatus of claim 8 wherein said current controlled material is electroluminescent and is ZnS, II-II-Vi ternary compounds, SiC or compounds containing an oxide and is color doped to produce red, green or blue electroluminescence.

13. The apparatus of claim 8 wherein said current controlled material is electroluminescent material doped with 8hydroxyquinoline aluminum or Tris(8-quinolinolato) aluminum III to produce color electroluminescence.

14. The apparatus of claim 8 including hole transport material of $ZnSnAS_2$, $SnSiAs_2$ with ZnS, or polymer/diamine with $Alq_3$ in said current controlled material.

15. The apparatus of claim 11 wherein said II-II-Vi ternary compound is $ZnxCd_{x-1}S$ and said oxide is zinc gallate.

16. The method for operating a display matrix integrated circuit element comprising the steps of:

(a) forming a triode element comprising an injector and a collector electrode in ohmic contact with a current controlled material, and a gate electrode in contact with said current controlled material;

(b) creating and modulating the extent of a depletion region within said current controlled material in the vicinity of said gate electrode by varying the potential of said gate electrode;

(c) applying a voltage potential across said injector and collector electrodes;

(d) changing the potential of said gate electrode until avalanche occurs within said current controlled material between said injector and said collector electrodes; and (e) changing the integrated circuit conditions resulting from said avalanche condition.

* * * * *